US010787290B2

(12) United States Patent
Berkes

(10) Patent No.: US 10,787,290 B2
(45) Date of Patent: Sep. 29, 2020

(54) PALLET MADE OF CORRUGATED PAPERBOARD

(71) Applicant: Mihály Berkes, Budapest (HU)

(72) Inventor: Mihály Berkes, Budapest (HU)

( * ) Notice: Subject to any disclaimer, the term of this patent is extended or adjusted under 35 U.S.C. 154(b) by 13 days.

(21) Appl. No.: 15/754,625

(22) PCT Filed: Sep. 2, 2016

(86) PCT No.: PCT/HU2016/000057
§ 371 (c)(1),
(2) Date: Feb. 23, 2018

(87) PCT Pub. No.: WO2017/037483
PCT Pub. Date: Mar. 9, 2017

(65) Prior Publication Data

US 2018/0244430 A1 Aug. 30, 2018

(30) Foreign Application Priority Data

Sep. 4, 2015 (HU) ..... 15 00147

(51) Int. Cl.
*B65D 19/00* (2006.01)

(52) U.S. Cl.
CPC ..... *B65D 19/0073* (2013.01); *B65D 2519/00019* (2013.01); *B65D 2519/00054* (2013.01);
(Continued)

(58) Field of Classification Search
CPC ..... B65D 2519/00089; B65D 2519/00333; B65D 2519/00338; B65D 2519/00373;
(Continued)

(56) References Cited

U.S. PATENT DOCUMENTS 3,911,834 A 10/1975 Quaintance
3,940,101 A * 2/1976 Heidelbach ..... B65D 19/20 248/346.4

(Continued)

FOREIGN PATENT DOCUMENTS

EP 0 334 329 A2 9/1989

OTHER PUBLICATIONS

International Search Report (PCT/ISA/210) issued in PCT/HU2016/000057, dated Jan. 11, 2017.

(Continued)

*Primary Examiner* — Matthew W Ing
(74) *Attorney, Agent, or Firm* — Birch, Stewart, Kolasch & Birch, LLP

(57) ABSTRACT

The pallet includes two fixing surfaces produced from rectangular base plate with the help of scoring and made by folding and having two lifting holes, and supporting cover containing legs having intrinsic lifting holes and bracing space, the fixing surface of the supporting cover is fixed to bracing plate, which is fixed to the lower surface of the loading surface of the pallet, and to the bottom of the bracing plate the middle supporting cover is fixed, which is formed by folding from rectangular middle base plate created with scorings and two lifting holes, containing the supporting legs which include the two fixing surfaces, lifting holes and bracing space, along the entire length of its two fixing surfaces and the bracing space of the supporting legs, in its upper part completely filled beams are fixed, and cylinders are fixed in a space filleting manner below the completely filled beams in the bracing space of the supporting legs.

20 Claims, 8 Drawing Sheets

(52) U.S. Cl.
CPC ..... *B65D 2519/00124* (2013.01); *B65D 2519/00273* (2013.01); *B65D 2519/00293* (2013.01); *B65D 2519/00323* (2013.01); *B65D 2519/00333* (2013.01); *B65D 2519/00432* (2013.01); *B65D 2519/00562* (2013.01)

(58) Field of Classification Search
CPC ..... B65D 2519/00378; B65D 2519/00447; B65D 2519/00562; B65D 19/0073
See application file for complete search history.

(56) References Cited

U.S. PATENT DOCUMENTS

| | | | | |
|---|---|---|---|---|
| 4,863,024 | A * | 9/1989 | Booth | B65D 19/0016 206/386 |
| 5,195,440 | A * | 3/1993 | Gottlieb | B65D 19/0026 108/51.3 |
| 5,503,085 | A * | 4/1996 | Rozek | B65D 19/0087 108/51.3 |
| 6,354,229 | B1 * | 3/2002 | Heidtke | B65D 19/0012 108/51.3 |
| 6,357,364 | B1 * | 3/2002 | Maloney | B65D 19/0026 108/51.11 |
| 2006/0065170 | A1 * | 3/2006 | Chen | B65D 19/0026 108/51.3 |
| 2009/0223422 | A1 * | 9/2009 | Monteith | B65D 19/0026 108/51.3 |

OTHER PUBLICATIONS

Written Opinion (PCT/ISA/237) issued in PCT/HU2016/000057, dated Jan. 11, 2017.

* cited by examiner

PALLET MADE OF CORRUGATED PAPERBOARD

The subject of the invention is a pallet made of corrugated paperboard, which has a high load carrying capacity and which ensures the stable, damage free and safe storage and transport of goods placed on the surface of the pallet.

Pallets are used very frequently for storing and loading goods. Timber boards are usually used for producing pallets, but pallets are also made recently from corrugated paperboard. Products made of paper base materials, including pallets, allow the use of environmental friendly technologies, because paper can be processed repeatedly many times to prepare base material for further paper products.

According to the state of art the Hungarian patent description P 08 00311 makes known paper based pallet to be used for handling of goods, which contains a loading body for receiving the goods, and have supporting legs below the loading body, where the loading body has an upper supporting plate and lower supporting plate attached to it, while at least some of supporting legs have connecting member which touches and supports the lower loading plate of the loading body, and the legs also have bordering members along the connecting member, and the loading body has coupling shapes that lean down towards the supporting legs and are fixed to the supporting legs. This solution is characterised by guiding troughs sunken into the internal side of upper supporting plate of the loading body facing the lower supporting plate and/or into the internal side of lower supporting plate facing the upper supporting plate, and/or at least some of the supporting legs have flares passing through the bordering members, where the flare is bordered from below by the bottom supporting member of the supporting legs touching the ground, and/or an insulating coating is provided to at least some of the supporting legs at the part of the bordering members in the vicinity of the lower supporting member.

The Hungarian utility model document filing No. HU U 06 00266, registration No. HU U 3314 makes known paper based pallet with improved load carrying capacity for moving goods, which contains a loading body for receiving the goods to be moved, and leg members below the loading body, at least some of the leg members have enveloping body surrounding the internal void, and the at least some of the leg members have connecting surface which is in contact with the lower surface of the loading body and serves for supporting the loading body, and has bordering surface running along the connecting surface. One of its features is the upper supporting plate of the loading body to which a lower supporting plate is fixed, where the upper supporting plate has one or more lateral coupling extension that lean down towards the leg members, while the lower supporting plate have lugs extended also in the direction of the leg members, the lateral coupling extensions have external coupling surface, the lugs have internal coupling surface, while external coupling surfaces of the lateral coupling extensions and the internal coupling surfaces of the lugs are fixed to the bordering surfaces of the respective leg members.

The Hungarian utility model document No. U 03 00177, registration No. HU 2651 makes known paper based pallet for moving of goods, which has supporting plate having a load carrying surface being in touch with the goods, and leg bodies situated at the connecting side of the supporting plate opposite to the supporting surface, where the leg bodies have enveloping surfaces being shaped as straight prism, and the longitudinal axis of the leg bodies is parallel with the main plane of the load carrying surface of the supporting plate. It is characterised by an internal hollow in the leg body surrounded by the enveloping surface, and there is one or more bracing insert in the internal void, where the longitudinal axis of the bracing inert is aligned at an angle relative to the longitudinal axis of the leg body different from 0°, preferably between 60° and 120°.

The disadvantage of the solutions described above, and the solutions used in practise is the fact that the legs are attached to the loading surface as independent units. As a result of this, the legs could be broken down during the transport of the pallet when a higher force is exerted to them by the fork of trucks (impacts approach), thus rendering the pallet useless, and an excessively complicated process is used.

With the development of the pallet made of corrugated paperboard we had the aim to create a pallet, which has a suitable load carrying capacity to ensure the stable, damage free and safe storage and transport of goods placed on the surface of the pallet in addition to the fact that the impact on the environment is mitigated by its production.

When developing the pallet according to the invention we recognised, that if the fixing surface of the supporting surface is fixed to the bracing plate, which is fixed to the lower surface of the loading surface of the supporting cover that contains two fixing surfaces, lilting holes and the legs with their bracing spaces, formed form rectangular base plate having scorings and two lifting holes twice by means of folding, and the middle supporting cover with its two fixing surfaces is fixed to the bottom of the bracing plate containing two fixing surfaces, lifting holes and supporting legs with their bracing spaces, formed form rectangular middle base plate having scorings and two lifting holes twice by means of folding, and completely filled beams are fixed in the upper part of the bracing space of supporting length along the entire length L, and cylinders are fixed in a space filling manner beneath the completely filled beams in the bracing space of the supporting legs, then the planned aim can be achieved.

The invention is a pallet made of corrugated paperboard, which is created with loading surface, supporting legs and lifting holes. It is characterised by that, the pallet consists of two fixing surfaces produced from rectangular base plate with the help of scoring and made by means of folding and having two lifting holes, and supporting cover containing legs having intrinsic lifting holes and bracing space, the fixing surface of the supporting cover is fixed to bracing plate, which is fixed to the lower surface of the loading surface of the pallet, and to the bottom of the bracing plate the middle supporting cover is fixed, which is formed by means of folding from rectangular middle base plate created with scorings and two lifting holes, containing the supporting legs which include the two fixing surfaces, lifting holes and bracing space, along the entire length of its two fixing surfaces and the bracing space of the supporting legs, in its upper part completely filled beams are fixed, and cylinders are fixed in a space filleting manner below the completely filled beams in the bracing space of the supporting legs.

In a preferred embodiment of the pallet according to the invention, one cylinder is fixed in the supporting legs, while two cylinders are fixed in the middle supporting legs.

In another preferred embodiment of the pallet according to the invention, the length of middle supporting legs is equal to or larger than the diameter of the two cylinders, such as $L1 \geq 2D$.

In a further preferred embodiment of the pallet according to the invention, the sum of the height of the completely filled beam and the height of the cylinder is equal to the height of the bracing space, such as M3+M4=M2.

In a further preferred embodiment of the pallet according to the invention, the completely filled beam is created by adhering together M3×L sized rectangular corrugated paperboards.

In a further preferred embodiment of the pallet according to the invention, the completely filled beam is created by accordion type folding of rectangular corrugated paperboard.

In a further preferred embodiment of the pallet according to the invention, the completely filled beam is created from rectangular corrugated paperboard by folding at the middle towards the wide horizontal part with accordion type folding, and the edges pf the rectangular paperboard are folded next to one another.

In a further preferred embodiment of the pallet according to the invention, the width of the completely filled beam is equal to the width of the bracing space.

In a further preferred embodiment of the pallet according to the invention, the size of the bracing plate is equal to the size L×S of the loading surface of the supporting cover.

In a further preferred embodiment of the pallet according to the invention, the frame of the pallet is created from a single plate by means of folding, so that the plate is folded along the scorings next to the lifting holes formed in the plate, thus creating the supporting legs, on which the upper supporting cover and the lower supporting cover are folded, and then the completely filled beams and the cylinders are inserted in the bracing spaces of the supporting legs.

The pallet according to the invention is set forth on the base of the attached Figures:

FIG. 1 shows the perspective view of the pallet 1 according to the inventions.

FIG. 2. shows the pallet introduced in FIG. 1 with its internal arrangement schematically.

Figure 1:
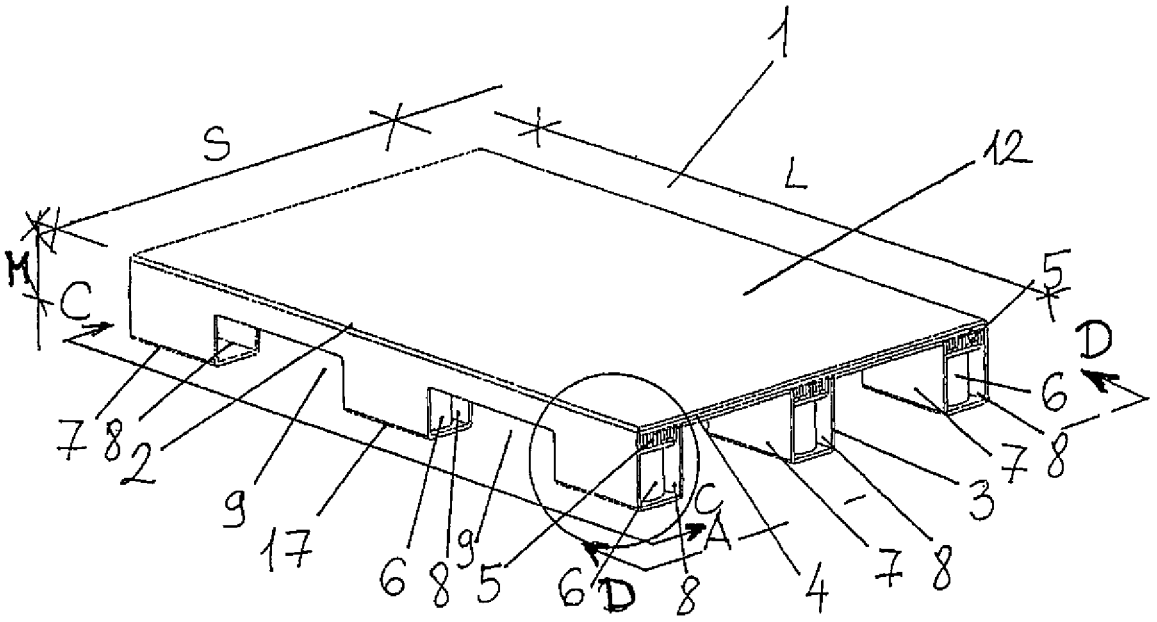
Figure 2:
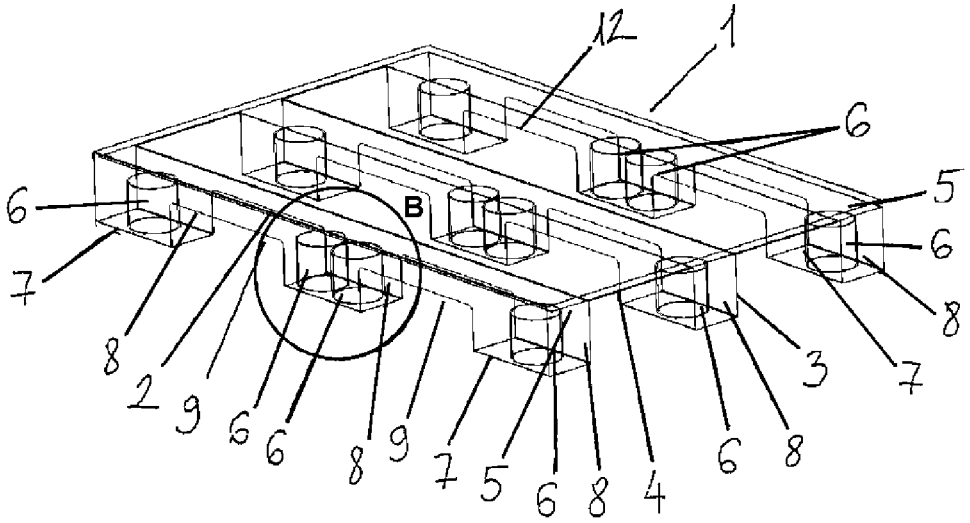
Figure 3:
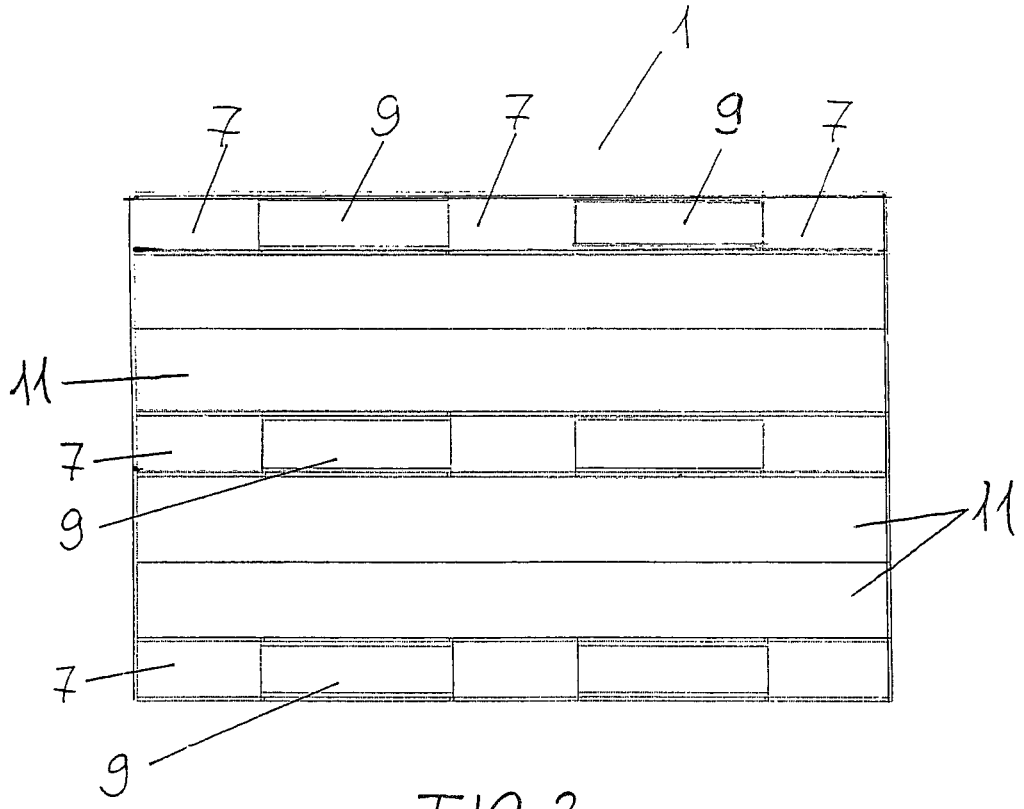
FIG. 3 shows the bottom view of the pallet introduced in FIG. 1.

FIG. 1 shows the perspective view of the pallet 1 according to the inventions. FIG. 2. shows the pallet 1 introduced in FIG. 1 with its internal arrangement schematically. FIG. 3 shows the bottom view of the pallet 1 introduced in FIG. 1. The figures includes the supporting cover 2 of the pallet 1 having length L, width S and height M, as well as its middle supporting cover 3 and bracing plate 4. Further parts that can be seen in the figure include the bracing spaces 8 of the supporting legs 7, 17 formed by the supporting cover 2 and the middle supporting cover part 3, as well as the completely filled beams 5 in the bracing spaces 8, and the cylinders 6. The lifting holes 9 formed in the supporting legs 7, 17 can be well seen in the figure, together with the cylinder 6 within each supporting legs 7 and two cylinders 6 in each supporting leg 17.

The size of the bracing plate 4 is identical to the L×S size of the loading surface of the supporting cover 2.

Figure 4:
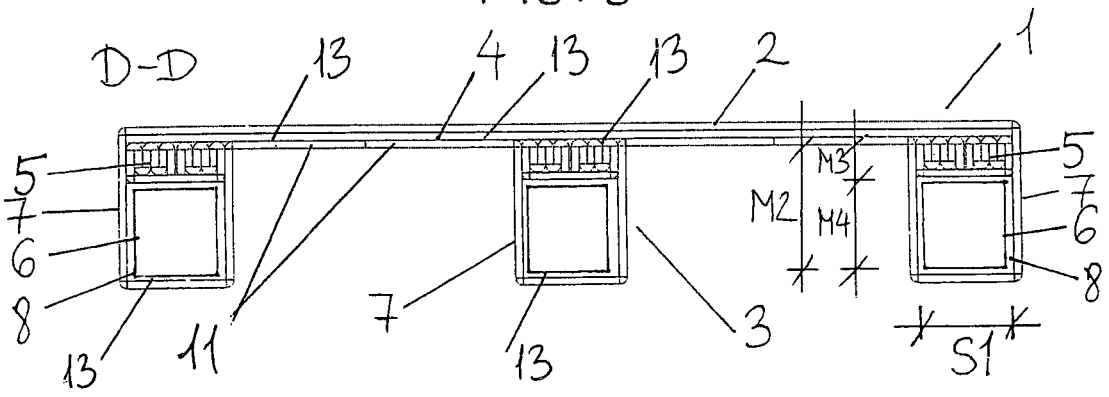
FIG. 4 shows section D-D indicated in FIG. 1.

FIG. 4 shows section D-D indicated in FIG. 1. It can be seen in the figure, that the pallet 1 has a supporting cover 2, middle supporting cover 3 and bracing plate 4. The bracing spaces 8 can also be seen, which are formed with internal width S1 of supporting legs 7 created by the supporting cover 2 and the middle supporting cover 3, as well as the completely filled beams 5 in the upper part of the bracing spaces 8, and the cylinders 6.

As can be seen in the figure, the height M2 of the bracing space 8 is equal to the sum of height M3 of the completely filled beam 5 and the height M4 of the cylinder 6, i.e. M2=M3+M4. It is also evident from the figure that diameter D of the cylinders is the same or less than the width S1 of bracing spaces 8, i.e. D≤S1.

Figure 5:
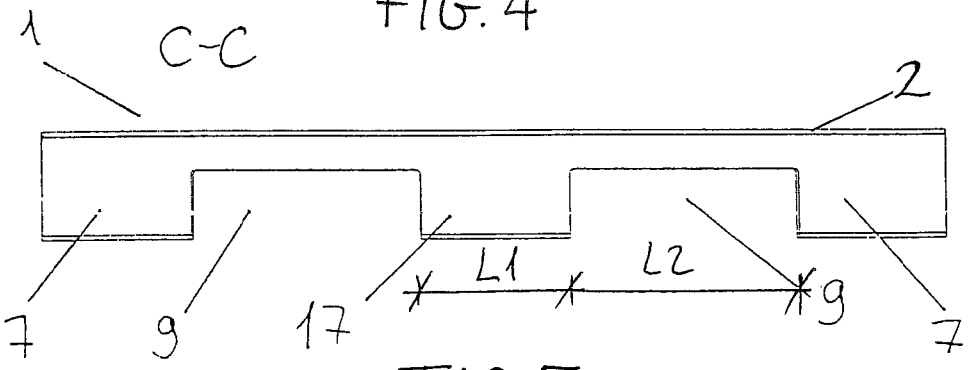
FIG. 5 shows detail C-C indicated in FIG. 1.

FIG. 5 shows detail C-C indicated in FIG. 1. The supporting cover 2 of the pallet 1 can be seen in the figure. The legs 7, 17 can be seen here together with the lifting holes 9 created between them.

Figure 6:
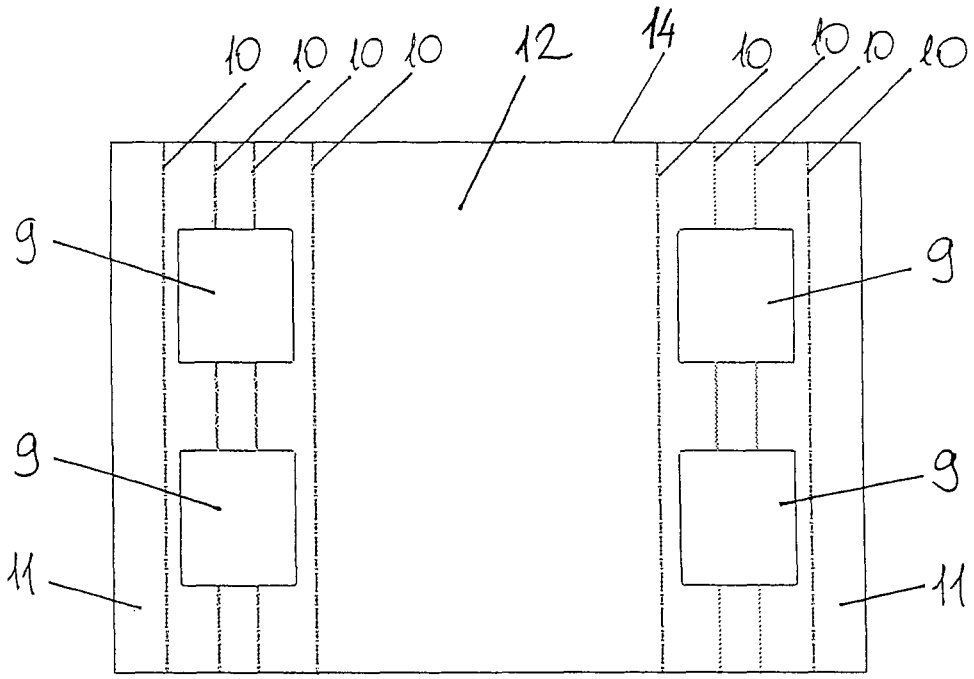
FIG. 6 shows the spread-view of supporting element of the pallet 1 according to the invention.

FIG. 6 shows the spread-view of supporting element of the pallet 1 according to the invention. The figure shows the base plate 14. The supporting cover 2 of the pallet 1 is formed from the developed base please 14 by means of folding. The figure shows the two lifting holes 9 twice, the scorings 10, which facilitate the folding operation, as well as the fixing surface 11.

Figure 7:
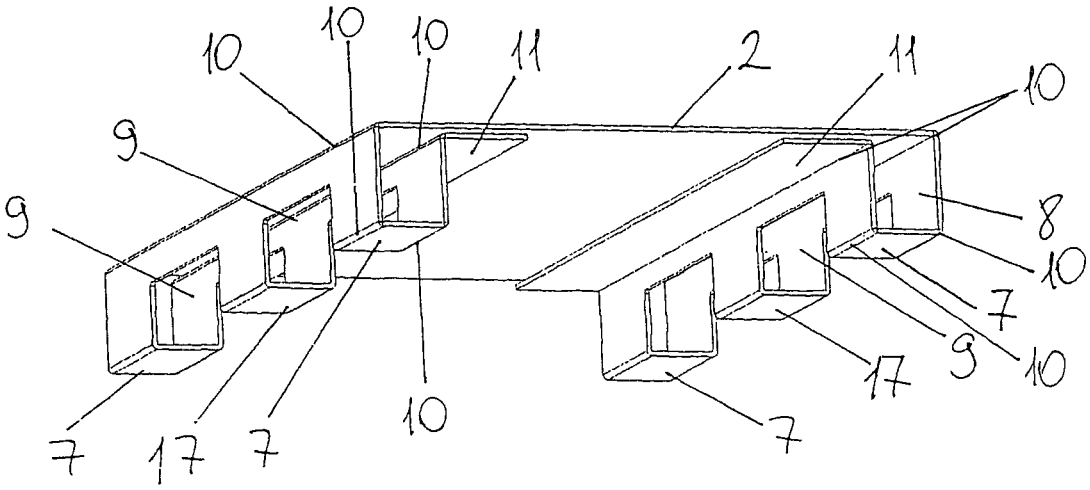
FIG. 7 shows the image of the folded supporting element introduced in FIG. 6.

FIG. 7 shows the image of the folded supporting element introduced in FIG. 6.

The supporting cover 2 can be seen in the figure in the condition after folding with the help of scorings 10, together with the supporting legs 7, 17 and the lifting holes 9 formed in the supporting legs 7, 17 and the bracing spaces 8 created in them, and the fixing surface 11.

Figure 8:
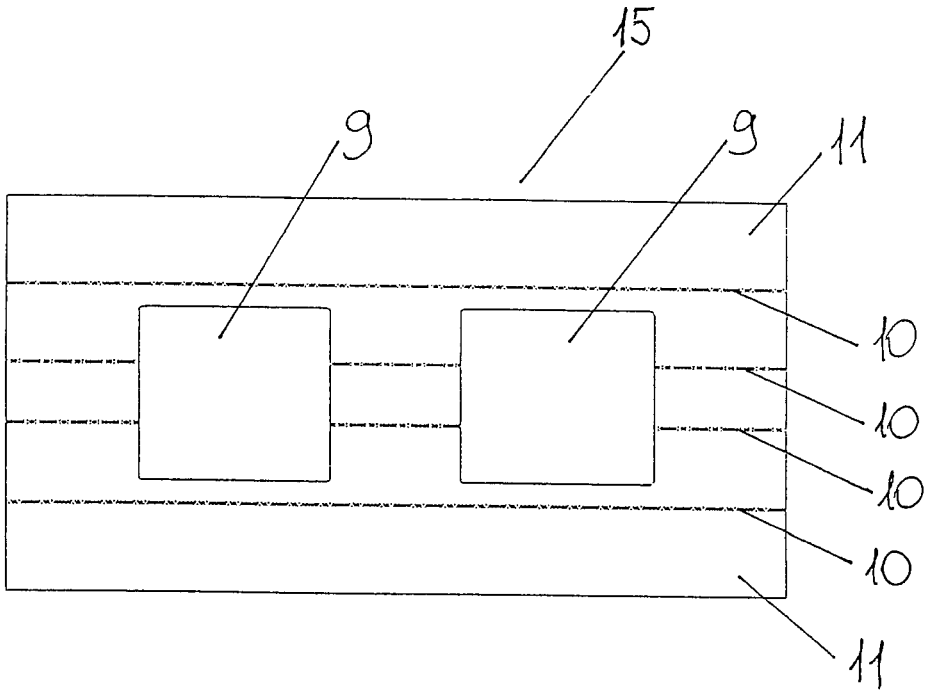
FIG. 8 shows the developed image of the supporting part of the pallet according to the invention.

FIG. 8 shows the developed image of the supporting part of the pallet according to the invention. The middle base plate 15 can be seen in the figure, from which the middle supporting cover 3 of the pallet 1 is formed by means of folding. The two lifting holes 9 can be seen in the figure, together with the scoring 10 used for facilitating the folding, and the fixing surfaces 11.

Figure 9:
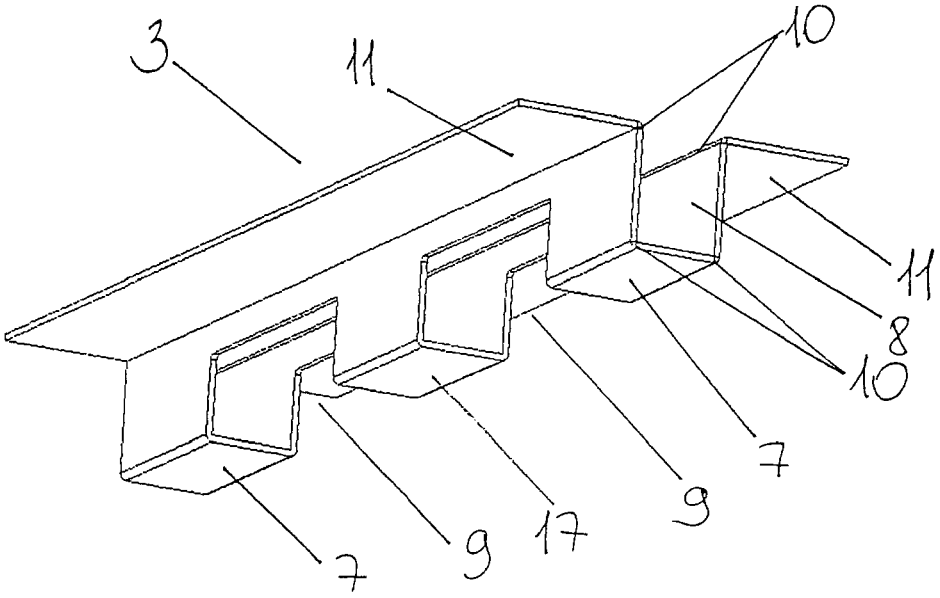
FIG. 9 shows the image of the folded supporting part introduced in FIG. 8.

FIG. 9 shows the image of the folded supporting part introduced in FIG. 8. The figure show the middle supporting cover 3 in a conditions formed by folding with the help of scorings 10, together with the supporting legs 7, 17 and the lifting holes 9 created between them, and with bracing spaces 8 situated between them, and the fixing surface 11.

Figure 10:
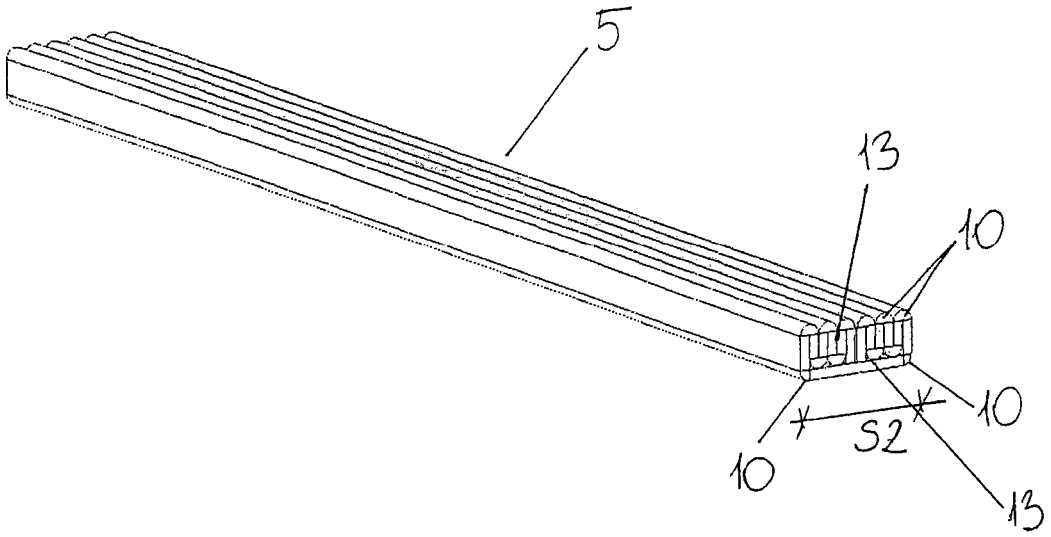
FIG. 10 shows the perspective view of the completely filled beam of the pallet according to the invention.

FIG. 10 shows the perspective view of the completely filled beam of the pallet according to the invention. The completely filled beam 5 can be seen in the figure, which is created by means of appropriate fording of a rectangular plate.

Figure 11:
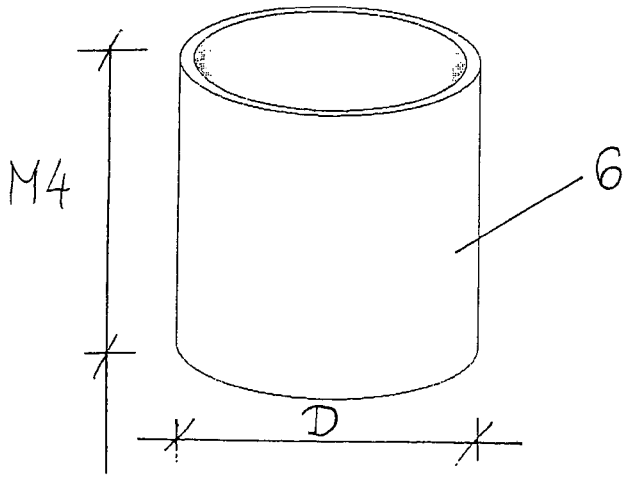
FIG. 11 shows the perspective view of the cylinder of the pallet according to the invention.

FIG. 11 shows the perspective view of the cylinder of the pallet according to the invention. The cylinder 6 having a diameter D and a height M4 can be seen in the figure.

Figure 12:
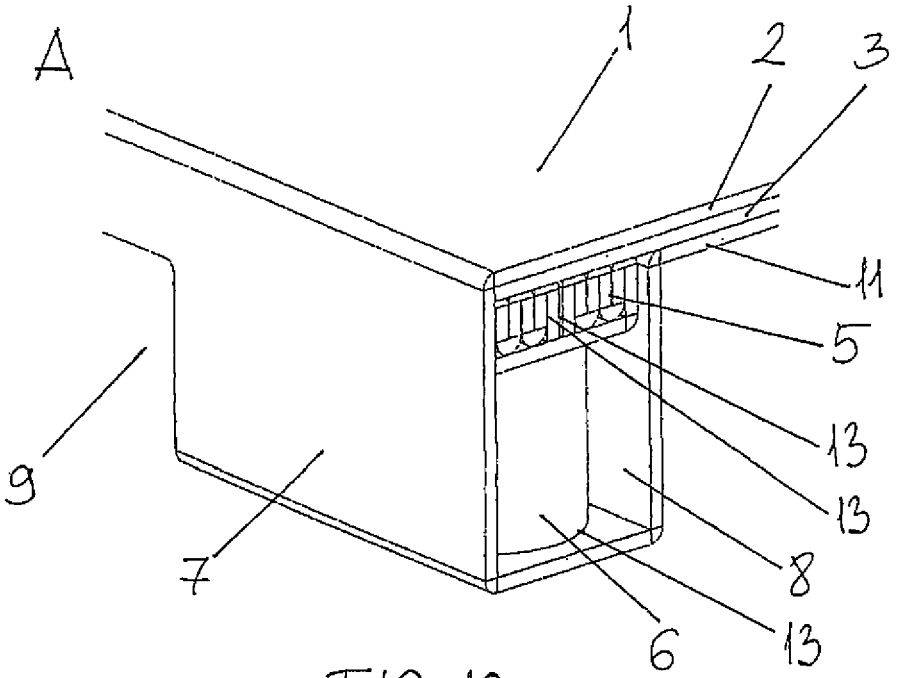
FIG. 12 shows an enlarged version of view A indicated in FIG. 1.

FIG. 12 shows an enlarged version of view A indicated in FIG. 1. The supporting cover 2, together with the supporting legs 7 and with its bracing space 8 can be seen in the figure, where the completely filled beams 5 and the cylinders 6 are also shown.

Figure 13:
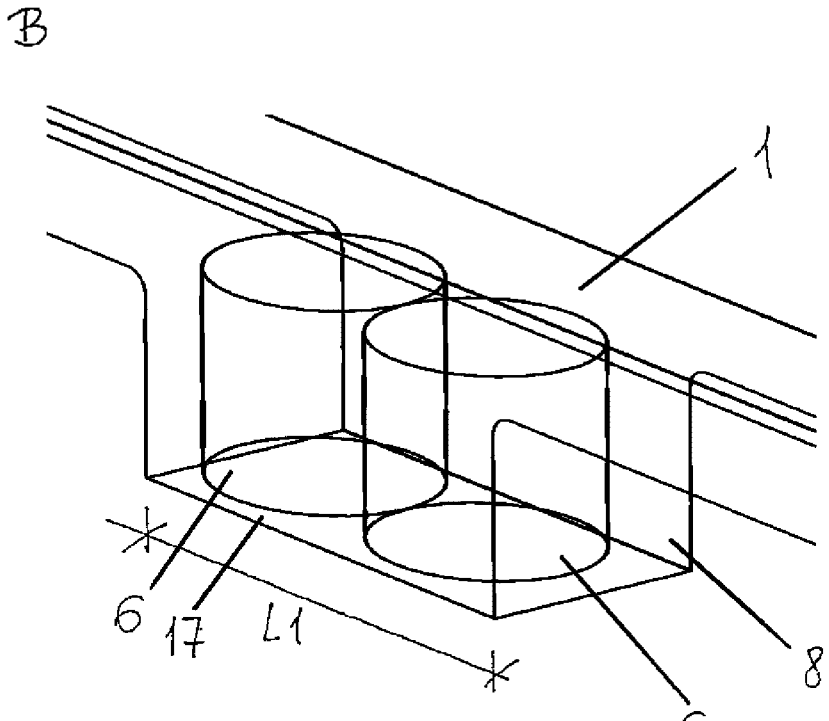
FIG. 13 shows an enlarged version of view B indicated in FIG. 2.

FIG. 13 shows an enlarged version of view B indicated in FIG. 2. In the figure it is possible to see the supporting leg 17 formed by the supporting cover 2, and its bracing space 8 having length L1, and the completely filled beams 5 placed in it, and the two cylinders 6. It is also evident from the figure that length L1 of the middle supporting legs 17 is larger than or equal to diameter D of the two cylinders 6, such as L1≥2D.

Figure 14:
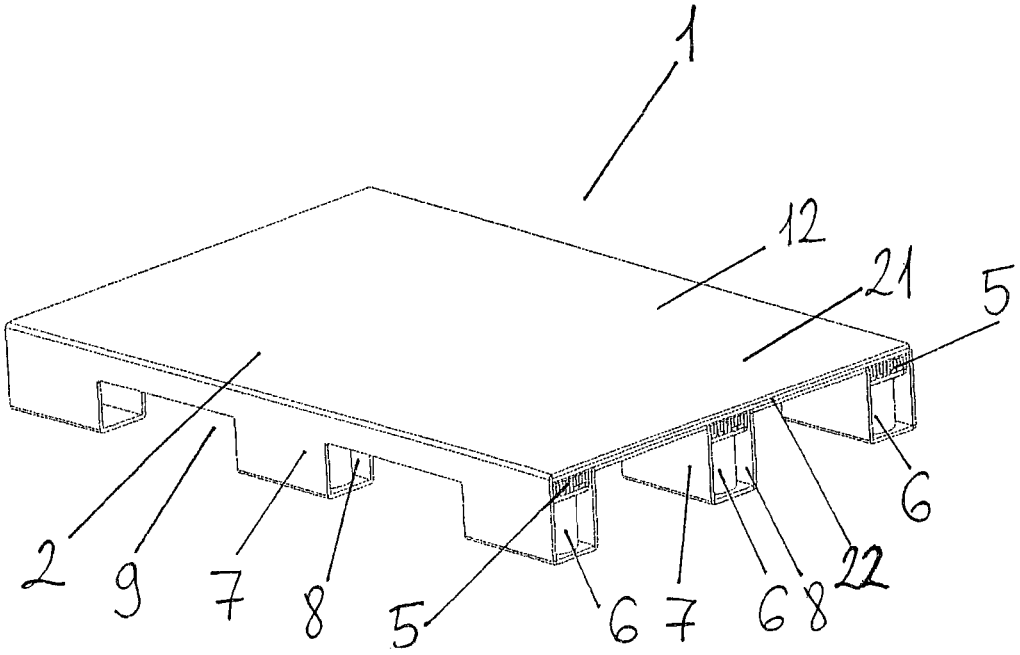
FIG. 14 shows the perspective view of pallet 1 created from a singe plate.
Figure 15:
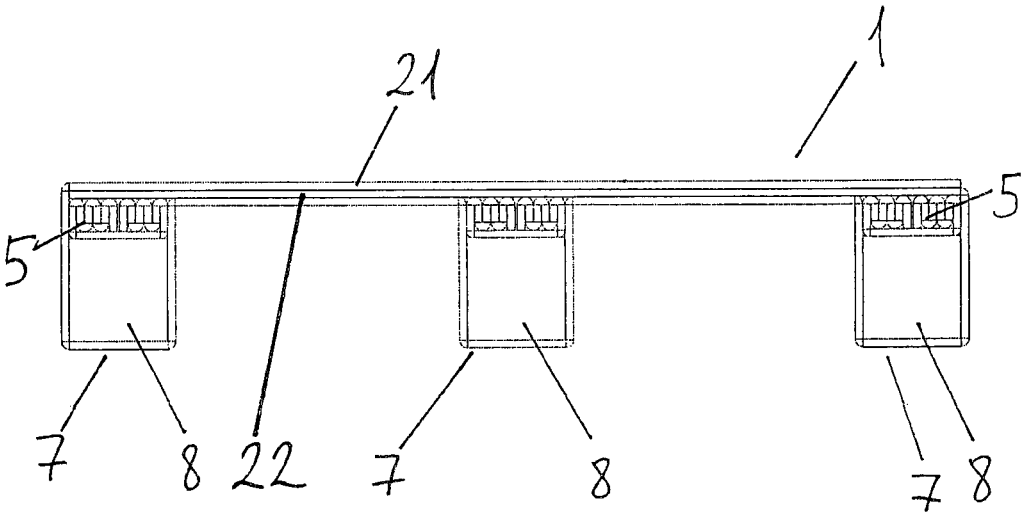
FIG. 15 shows the lateral view of the pallet 1 assembled according to FIG. 14.

FIG. 14 shows the perspective view of pallet 1 created from a singe plate. The pallet 1 with its loading surface 12 and supporting legs 7 can be seen in the figure. The cylinders 6 and the completely filled beams 5 are placed in the bracing spaces 8 situated within the supporting legs 7. Also, upper supporting cover 21 forming the supporting surface 12 can be seen in the figure together with the lower supporting cover 22 situated directly below it. FIG. 15 shows the lateral view of the pallet 1 assembled according to FIG. 14. The pallet 1 with its upper supporting cover 21 and the lower cover 22 situated below it can be seen in the figure. The figure also shows the supporting legs 7 with their bracing spaces 8, and the completely filled beam 5 within them.

As can be seen in the figure, the pallet 1 formed such a way from the plate 16 is folded next to the lifting holes 9 along the scorings 10 applied in the plate 16, and this is how the supporting legs 7 of the pallets 1 are created with bracing spaces 8. Then the lower supporting cover 22 is folded onto the supporting legs 7 thus created, and the upper supporting cover 21 is folded over it.

Figure 16:
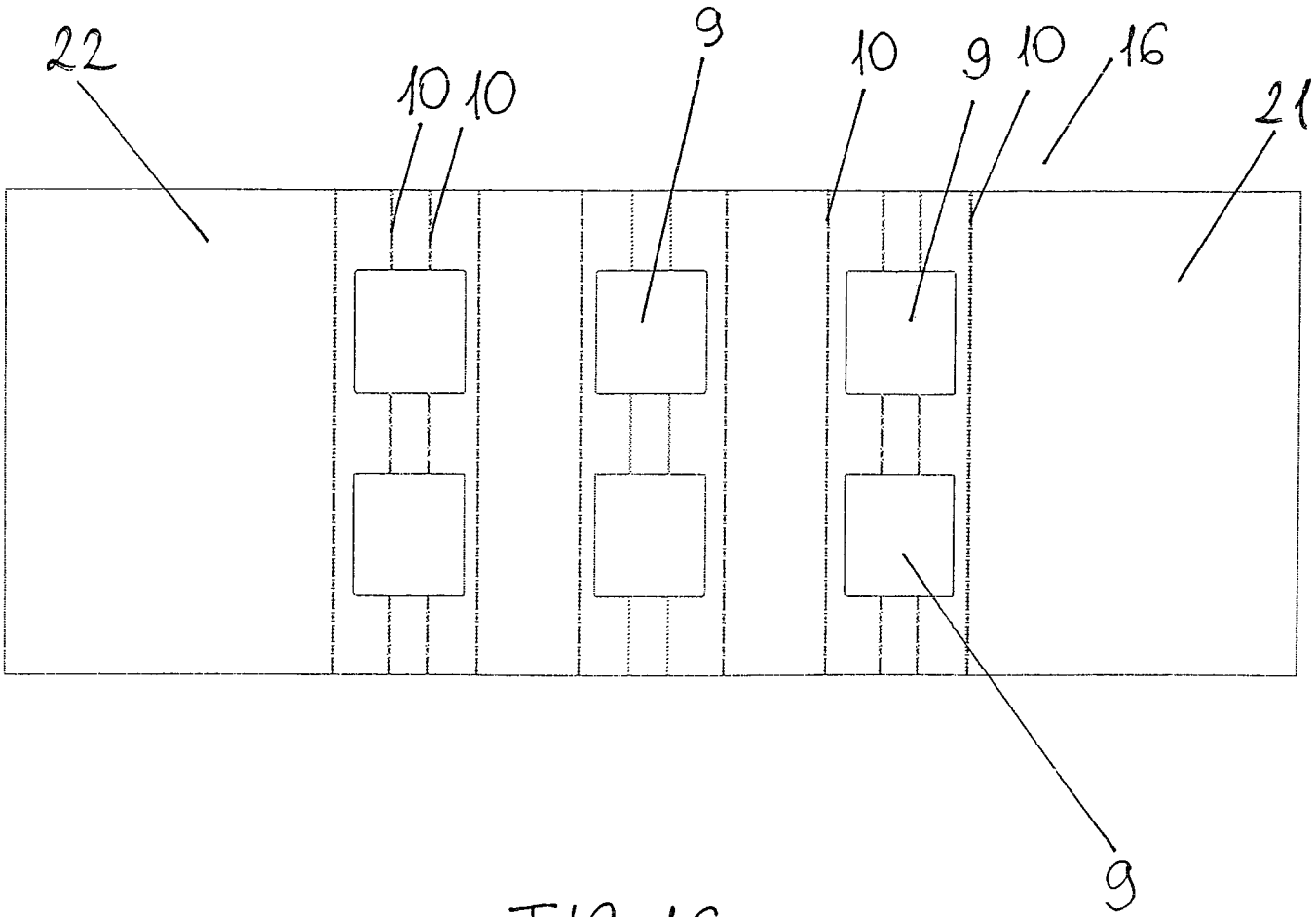
FIG. 16 shows the view of plate 16 from which the pallet 1 is made according to FIG. 14.

FIG. 16 shows the view of plate 16 from which the pallet 1 is made according to FIG. 14. The rectangular plate 16 can be seen in the figure, in which the locations of the lifting holes 9 are made by cutting out. Furthermore, scorings 10 are made in the plate 16, which scorings 10 facilitate the easier creation of legs 7 formed means of folding. The upper supporting covers 21 and the lower supporting covers 22 can be seen at the two extreme parts of the plate 16.

In case of a possible embodiment of the pallet according to the invention the supporting cover 2 is created first, which is made from the base plate 14, so from a rectangular corrugated paperboard. The places of twice the two lifting holes 9 are prepared by cutting out of the base plate 14, then scorings 10 are made in parallel with the side of the pallet 1 having a length L, which facilitate the folding of supporting cover 2, and the creation of legs 7, 17 and the fixing surface 11.

Then the middle supporting cover 3 is formed, which is made also from the middle base plate 15 being a rectangular corrugated paperboard. The places of the two lifting holes 9 are prepared by cutting out of the base plate 15, then scorings 10 are made in parallel with the side of the pallet 1 having a length L, which facilitate the folding of supporting cover 3, and the creation of legs 7, 17 and the fixing surface 11. The cylinders 6 with diameter D and height M4 are produced by means of known paper processing method with suitable wall thickness.

Then the completely filled beam 5 is created.

According to one of the possible modes of creating the completely filled beam 5, M3×L sized rectangular corrugated paperboards are adhered together to produce the completely filled beams 5 with size M3×L×S2. Here, the width S2 of the completely filled beam 5 is preferably equal to the width S1 of the bracing space 8, such as S1=S2

According to another possible mode of creating the completely filled beam 5, the a rectangular corrugated paperboard is subjected to accordion type folding, and the plates becoming adjacent to one another are preferably adhered together to produce the completely filled beam 5.

Yet another possible mode of producing the completely filled beam 5 includes an accordion type folding of a rectangular corrugated paperboard as shown in FIG. 10, and folding it over the S2 wide middle part for creating the completely filled beam 5, so that the internal edges of the rectangular corrugated paperboard are folded and preferable adhered next to each other.

In cases of the above described modes of producing the completely filled beam 5, it is preferred to fix the parts produced by the accordion type folding preferably by means of adhering them together.

After producing the various parts of the pallet 1 as described above, now the pallet may be assembled.

First the S×L sized bracing plate 4 also made of corrugated paperboard is placed on the internal surface of supporting cover 2, and fixed to it preferably by means of adhering. Then the supporting cover 2 is fixed to the bracing plate 4 with the help of its fixing surfaces 11. After that, the middle supporting cover 3 is fixed to the bracing plate 4 with the help of its fixing surfaces 11. Then the completely filled beams 5 are placed into the bracing space 8 situated in supporting legs 7, 17 formed in the supporting cover 2 and in the middle supporting cover 3, as fitted and preferably adhered to the bracing plate 4 along the entire length L. After that, the cylinders 6 are placed and fixed into the lower part pf bracing space 8 of legs 7, 17 beneath the completely filled beams 5, so that one cylinder 6 is placed in each supporting leg 7, and two cylinders 6 are placed in each the supporting leg 17.

In case of preferred actual embodiment, the dimensions of the pallet according to the invention can be harmonized with the relevant regulations, primarily with the dimensions of the forks of the fork lift truck.

The dimensions of the lifting hole 9 shall be determined accordingly. In case of a further possible embodiment of the pallet according to the invention the pallet 1 can be produced from a single plate by means of folding. Its structure is identical to the structure described above, but its production is different, that is, the frame of the pallet 1 is made from a rectangular plate 16 by means of folding, in which the completely filled beams 5 and the cylinders 6 are installed subsequently. It has manufacturing advantages, it is less expensive, requires less labour and manufacturing operations. Each corrugated cardboard element can be made as a single piece.

For the further possible embodiments of the pallet according to the invention other materials can be used, such as:

ribbed plastic corrugated sheet, or metal sheet or corrugated metal sheet.

The advantage of the pallet according to the invention include:

As a consequence of its construction it could be damaged by mechanical impact, i.e. when handled with fork lift truck, but its components are not prone to disengage from one another.

It has a low mass of 5 kg as opposed to the 22-25 kg of the timber pallet, therefore, the load on the transporting vehicles is much less and its use is much more efficient in economic terms.

The surface of pallet made of paper is even, clean and free from splinters, no nails are used, which might damage the packaging of the goods, thus the damages occurring frequently with timber pallets are eliminated.

It is hygienic, as opposed to the timber pallets, no pathogens, bacteria or other hazardous contamination can accumulate on it.

The paper pallets is more attractive because of it appearance and as a result of the possibility of its recycling.

Its commercial price is less by 20-30% relative to the price of the timber pallet.

It can be produced from reusable paper.

Further advantages:

Manufacturing advantages, the required labour is less.

The used paper will not become a hazardous waste.

The base material of the pallet may be environmental friendly plastic (PLA) too, which decomposes into environmental friendly materials and can be recycled to nature.

The pallet made of paper instead of the traditional timber base material can be used in more applications.

The advantages are as follows:

it is much lighter because of the reduction of mass, it is free from splinters, nails, and its surface is intrinsically smooth, it is reusable as a result of the base material, therefore, it is environmental friendly and more efficient in economic terms.

LIST OF REFERENCES

1—pallet
2—supporting cover
3—middle supporting cover
4—bracing plate
5—completely filled beam
6—cylinder
7—supporting leg
8—bracing space
9—lifting hole
10—scoring
11—fixing surface
12—loading surface
13—adhering
14—base plate
15—middle base plate
16—plate
17—supporting leg
21—upper supporting cover
22—lower supporting cover
L—length
L1—length
L2—length
S—width
S1—width
S2—width
M—height
M2—height
M3—height
M4—height
D—diameter

The invention claimed is:

1. Pallet made of corrugated paperboard, which is created with loading surface, supporting legs and lifting holes, the pallet consisting of faces produced from rectangular base plate with the help of scoring and made by means of folding and having two lifting holes, and supporting cover containing legs having intrinsic lifting holes and bracing space, the fixing surface of the supporting cover is fixed to bracing plate, which is fixed to the lower surface of the loading surface of the pallet, and to a bottom of the bracing plate a middle supporting cover is fixed, which is formed by means of folding from rectangular middle base plate created with scorings and two lifting holes, containing the supporting legs which include the two fixing surfaces, lifting holes and bracing space, along an entire length (L) of the two fixing surfaces and the bracing space of the supporting legs, in its upper part completely filled beams are fixed, and cylinders are fixed in a space filleting manner below the completely filled beams in the bracing space of the supporting legs.

2. Pallet according to claim 1, wherein one cylinder is fixed in the supporting legs, while two cylinders are fixed in the middle supporting legs.

3. Pallet according to claim 1, wherein a length (L1) of middle supporting legs is equal to or larger than a diameter (D) of the two cylinders, where L1≥2D.

4. Pallet according to claim 1, wherein the sum of a height (M3) of the completely filled beam and a height (M4) of the cylinder is equal to the height (M2) of the bracing space, where M3+M4=M2.

5. Pallet according to claim 1, wherein the completely filled beam is created by adhering together M3×L sized rectangular corrugated paperboards.

6. Pallet according to claim 1, wherein the completely filled beam is created by accordion type folding of rectangular corrugated paperboard.

7. Pallet according to claim 1, wherein the completely filled beam is created from rectangular corrugated paperboard by folding at a middle towards a (S2) wide horizontal part with accordion type folding, and edges of the rectangular paperboard are folded next to one another.

8. Pallet according to claim 1, wherein a width (S2) of the completely filled beam is equal to a width (S1) of the bracing space.

9. Pallet according to claim 1, wherein a size of the bracing plate is equal to a size L×S of the loading surface of the supporting cover.

10. Pallet according to claim 1, wherein the frame of the pallet is created from a single plate by means of folding, so that the plate is folded along the scorings next to the lifting holes formed in the plate, thus creating the supporting legs, on which the upper supporting cover and the lower supporting cover are folded, and then the completely filled beams and the cylinders are inserted in the bracing spaces of the supporting legs.

11. Pallet according to claim 2, wherein the length (L1) of middle supporting legs is equal to or larger than the diameter (D) of the two cylinders, where L1≥2D.

12. Pallet according to claim 2, wherein the sum of the height (M3) of the completely filled beam and the height (M4) of the cylinder is equal to the height (M2) of the bracing space, where M3+M4=M2.

13. Pallet according to claim 3, wherein the sum of the height (M3) of the completely filled beam 5) and the height (M4) of the cylinder is equal to the height (M2) of the bracing space, where M3+M4=M2.

14. Pallet according to claim 2, wherein the completely filled beam is created by adhering together M3×L sized rectangular corrugated paperboards.

15. Pallet according to claim 3, wherein the completely filled beam is created by adhering together M3×L sized rectangular corrugated paperboards.

16. Pallet according to claim 4, wherein the completely filled beam is created by adhering together M3×L sized rectangular corrugated paperboards.

17. Pallet according to claim 2, wherein the completely filled beam is created by accordion type folding of rectangular corrugated paperboard.

18. Pallet according to claim 3, wherein the completely filled beam is created by accordion type folding of rectangular corrugated paperboard.

19. Pallet according to claim 4, wherein the completely filled beam is created by accordion type folding of rectangular corrugated paperboard.

20. Pallet according to claim 5, wherein the completely filled beam is created by accordion type folding of rectangular corrugated paperboard.

* * * * *